US007891656B1

(12) United States Patent
Hsu et al.

(10) Patent No.: US 7,891,656 B1
(45) Date of Patent: Feb. 22, 2011

(54) SHEET FEEDING APPARATUS WITH SHEET RELEASING MECHANISM

(75) Inventors: Wei-Hsun Hsu, Taipei (TW); Wen-An Huang, Taipei (TW); Chao-Min Yang, Taipei (TW); Chung-Kai Wang, Taipei (TW)

(73) Assignee: Primax Electronics Ltd., Taipei (TW)

( * ) Notice: Subject to any disclaimer, the term of this patent is extended or adjusted under 35 U.S.C. 154(b) by 0 days.

(21) Appl. No.: 12/618,985

(22) Filed: Nov. 16, 2009

(30) Foreign Application Priority Data

Aug. 21, 2009 (TW) ..... 98128170 A

(51) Int. Cl.
*B65H 3/06* (2006.01)

(52) U.S. Cl. ..... 271/117; 271/118

(58) Field of Classification Search ..... 271/117, 271/118, 121, 122, 273
See application file for complete search history.

(56) References Cited

U.S. PATENT DOCUMENTS 1,988,189 A * 1/1935 Dobson ..... 400/637.1
6,139,011 A * 10/2000 Huang et al. ..... 271/274
7,264,240 B1 * 9/2007 Lee et al. ..... 271/273
7,320,462 B2 * 1/2008 Takamatsu ..... 271/3.14
7,506,867 B2 * 3/2009 Lee et al. ..... 271/117
7,686,291 B2 * 3/2010 Miyazawa ..... 271/117
7,717,415 B2 * 5/2010 Kim et al. ..... 271/110
7,753,363 B2 * 7/2010 Liu et al. ..... 271/121
2008/0054549 A1 * 3/2008 Lee ..... 271/117

* cited by examiner

*Primary Examiner*—Kaitlin S Joerger
(74) *Attorney, Agent, or Firm*—Kirton & McConkie; Evan R. Witt

(57) ABSTRACT

A sheet feeding apparatus includes a sheet releasing mechanism, a casing, a sheet feeding channel, a sheet pick-up module and a driving shaft. The sheet releasing mechanism includes a control lever and a base. The control lever includes a protruding part. The base includes a first restriction groove and a second restriction groove. When the protruding part is accommodated within the first restriction groove, the sheet releasing mechanism is in a sheet-holding status. When the protruding part is accommodated within the second restriction groove, the sheet releasing mechanism is in a sheet-releasing status.

7 Claims, 7 Drawing Sheets

SHEET FEEDING APPARATUS WITH SHEET RELEASING MECHANISM

FIELD OF THE INVENTION

The present invention relates to a sheet feeding apparatus, and more particularly to an automatic sheet feeding apparatus with a sheet releasing mechanism.

BACKGROUND OF THE INVENTION

With the maturity of automatic sheet feeding technologies, automatic sheet feeding apparatus are widely used in a diversity of document processing machines such as printers, copiers and multifunction peripherals. The automatic sheet feeding apparatus are used for successively feeding a stack of documents into the inner portion of the document processing machine so as to implement associated operations and achieve the labor-saving purpose.

FIG. 1 is a schematic view illustrating a conventional automatic sheet feeding apparatus. As shown in FIG. 1, the automatic sheet feeding apparatus 1 comprises a sheet pick-up roller 10, a sheet separation roller 11, a sheet separation slice 12 and a sheet feeding channel 13. The sheet separation roller 11 is sheathed around a driving shaft 14. As such, upon rotation of the driving shaft 14, the sheet separation roller 11 is simultaneously rotated. For feeding a document by the automatic sheet feeding apparatus 1, the document should be fed into a sheet entrance 16 by the sheet pick-up roller 10 and then transported to the sheet separation roller 11. The sheet separation roller 11 and the sheet separation slice 12 collectively offer a friction force on the document, so that only one document is allowed to be fed into the sheet feeding channel 13 for each time. Regardless of which kind of automatic sheet feeding apparatus is used, the document is readily jammed by using the sheet pick-up roller to feed the document. In a case that the evenness of the sheet-like document is insufficient, or in another case that too many documents are simultaneously fed by the sheet pick-up roller 10 to result in a double feeding problem, the possibility of getting jam of the document in the region between the sheet separation roller 11 and the sheet separation slice 12 is largely increased. Since the document is securely held between the sheet separation roller 11 and the sheet separation slice 12, the jammed document is not easily pulled out. If the jammed document is directly pulled out by exerting a pulling force on the document, the automatic sheet feeding apparatus 1 is readily suffered from a breakdown or the document is possibly broken.

For solving these drawbacks, the conventional automatic sheet feeding apparatus 1 usually has an additional sheet releasing mechanism. In a case that the automatic sheet feeding apparatus 1 is suffered from the jamming problem, the user may control the sheet releasing mechanism to shift the axle center of driving shaft 14 from the position A to the position B. As a consequence, the sheet separation roller 11, which is mounted on the driving shaft 14, is also deviated from its original axle center and no longer in close contact with the jammed document. Under this circumstance, the user may pull out the jammed document between the sheet separation roller 11 and the sheet separation slice 12. An automatic sheet feeding apparatus having a sheet releasing mechanism is disclosed in for example Taiwanese Patent Publication No. I303608.

FIG. 2 is a schematic exploded view illustrating a sheet releasing mechanism disclosed in Taiwanese Patent Publication No. I303608. As shown in FIG. 2, the sheet releasing mechanism 2 comprises a base 20 and a control lever 21. The control lever 21 comprises a pivotal part 211, a collar 212 and a handle part 213. The collar 212 is arranged between the pivotal part 211 and the handle part 213. The pivotal part 211 is substantially a cylindrical post serving as a rotating shaft of the control lever 21. The collar 212 is substantially a circular channel sheathed around the driving shaft 14 of an automatic sheet feeding apparatus 1 (see FIG. 1).

FIGS. 3A and 3B are schematic views illustrating a process of removing a jammed document by using the sheet releasing mechanism disclosed in Taiwanese Patent Publication No. I303608. For positioning the sheet releasing mechanism 2, the control lever 21 and the base 20 comprise a salient 214 and an indentation 201, respectively. When the salient 214 is engaged with the indentation 201, the control lever 21 is fixed onto the base 20. During normal feeding operation of the automatic sheet feeding apparatus 1, the engagement of the salient 214 and the indentation 201 prevents the control lever 21 from being rotated with respect to the base 20. Under this circumstance, the operation of the driving shaft 14 is not influenced by the control lever 21. In a case that the automatic sheet feeding apparatus 1 has a jamming problem, the user could stir the control lever 21 in the direction indicated by the arrow D (as shown in FIG. 3A), so that the salient 214 is disengaged from the indentation 201. Next, the user could stir the handle part 213 of the control lever 21 in the direction indicated by the arrow C (as shown in FIG. 3B) in order to rotate the collar 212 of the control lever 21. As a consequence, the sheet separation roller 11, which is mounted on the driving shaft 14, is deviated from its original axle center and no longer presses the jammed document.

Since the sheet releasing mechanism 2 has no additional structure for fixing the control lever 21 after the salient 214 of the control lever 21 is disengaged from the indentation 201, the control lever 21 is readily rocked back and forth. The rocking condition of the control lever 21 is troublesome during the process of pulling out the jammed document.

SUMMARY OF THE INVENTION

It is an object of the present invention to provide a sheet feeding apparatus with an easy-to-use sheet releasing mechanism.

In accordance with an aspect of the present invention, there is provided a sheet feeding apparatus with a sheet releasing mechanism. The sheet feeding apparatus includes a casing, a sheet feeding channel, a sheet pick-up module and a driving shaft. The casing has a first sidewall and a second sidewall. The sheet feeding channel is arranged between the first sidewall and the second sidewall. The sheet pick-up module includes a sheet separation roller and a sheet separation slice. The driving shaft is connected to the sheet pick-up module for driving the sheet separation roller. Both terminals of the driving shaft are respectively coupled to the first sidewall and the sheet releasing mechanism. The sheet releasing mechanism is operated in a sheet-holding status or a sheet-releasing status. The sheet releasing mechanism includes a control lever and a base. The control lever includes a protruding part for adjusting the sheet releasing mechanism to be in the sheet-holding status or the sheet-releasing status. The base is disposed on the second sidewall for supporting the control lever. The base includes a first restriction groove and a second restriction groove for accommodating the protruding part. When the protruding part is accommodated within the first restriction groove, the sheet releasing mechanism is in the sheet-holding status. When the protruding part is accommodated within the second restriction groove, the sheet releasing mechanism is in the sheet-releasing status.

In an embodiment, the control lever further includes a handle part, a pivotal part and a first collar. The handle part is operated for changing a position of the control lever such that the protruding part is accommodated within the first restriction groove or the second restriction groove. The first collar is used for accommodating a terminal of the driving shaft. The base further includes a receptacle for accommodating the pivotal part.

In an embodiment, the protruding part further includes a first gliding surface, and a second gliding surface is formed in the first restriction groove. When the sheet releasing mechanism is in the sheet-holding status, the first gliding surface is contacted with the second gliding surface.

In an embodiment, the protruding part further comprises a third gliding surface, and a fourth gliding surface is formed in the second restriction groove. When the sheet releasing mechanism is in the sheet-releasing status, the third gliding surface is contacted with the fourth gliding surface.

In an embodiment, the receptacle includes a mouth portion and a curvy bottom surface. The pivotal part of the control lever is permitted to be detached from the receptacle through the mouth portion. The curvy bottom surface is used for supporting the pivotal part.

In an embodiment, the control lever further includes a second collar, which is sheathed around the driving shaft for facilitating fixing the driving shaft.

In an embodiment, the sheet feeding apparatus further includes an upper cover pivotally coupled with the casing. The upper cover is permitted to be uplifted when the upper cover is rotated in an opening direction. The opening direction is the same as a direction of moving the protruding part from the first restriction groove to the second restriction groove.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
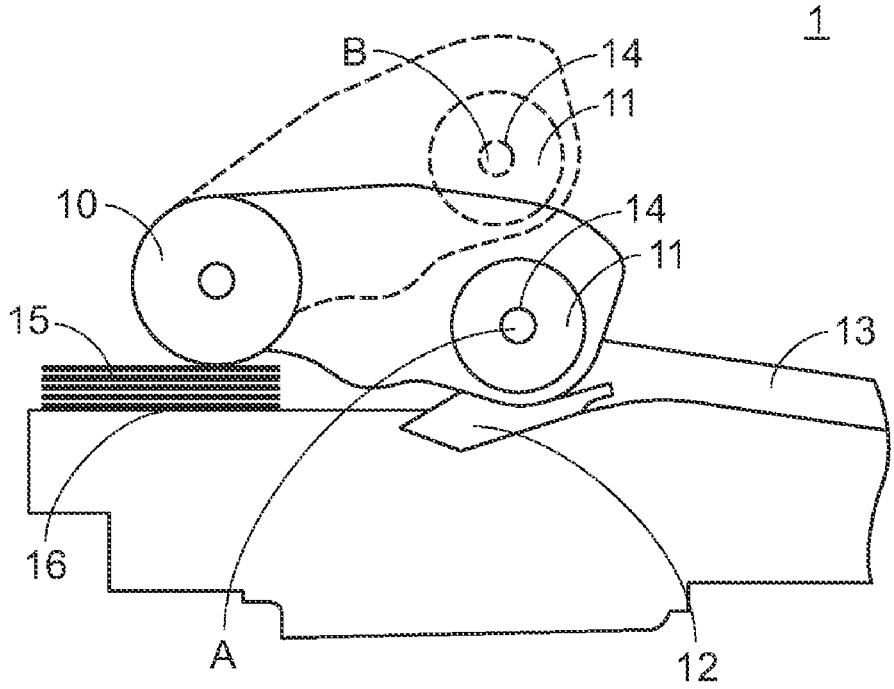
FIG.1 PRIOR ART
FIG. 1 is a schematic view illustrating a conventional automatic sheet feeding apparatus.
Figure 2:
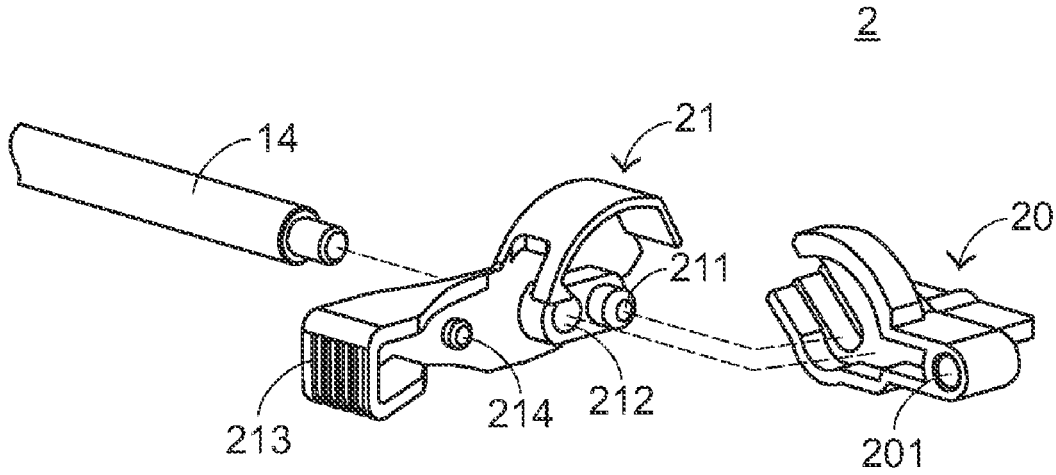
FIG.2 PRIOR ART
FIG. 2 is a schematic exploded view illustrating a sheet releasing mechanism disclosed in Taiwanese Patent Publication No. I303608.
Figure 3A:
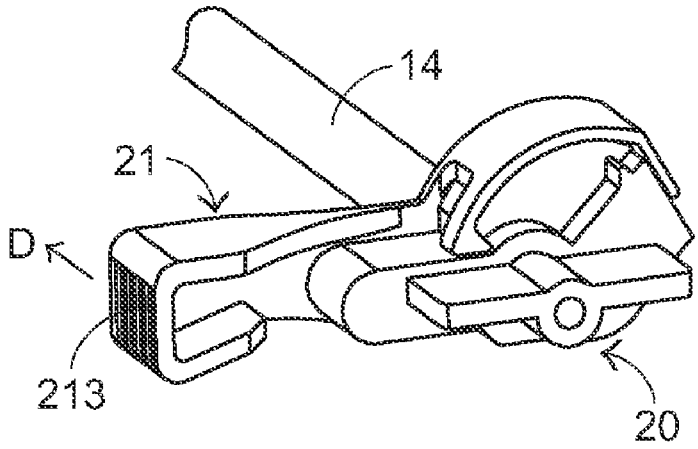
FIG.3A PRIOR ART
FIGS. 3A and 3B are schematic views illustrating a process of removing a jammed document by using the sheet releasing mechanism disclosed in Taiwanese Patent Publication No. I303608.
Figure 3B:
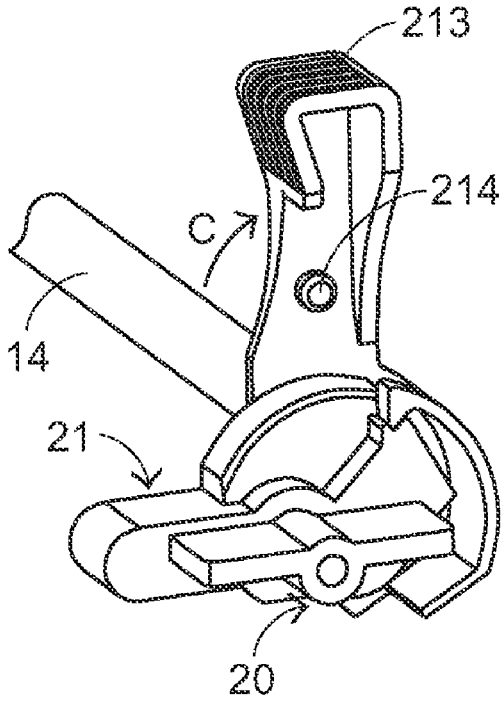
FIG.3B PRIOR ART
Figure 4:
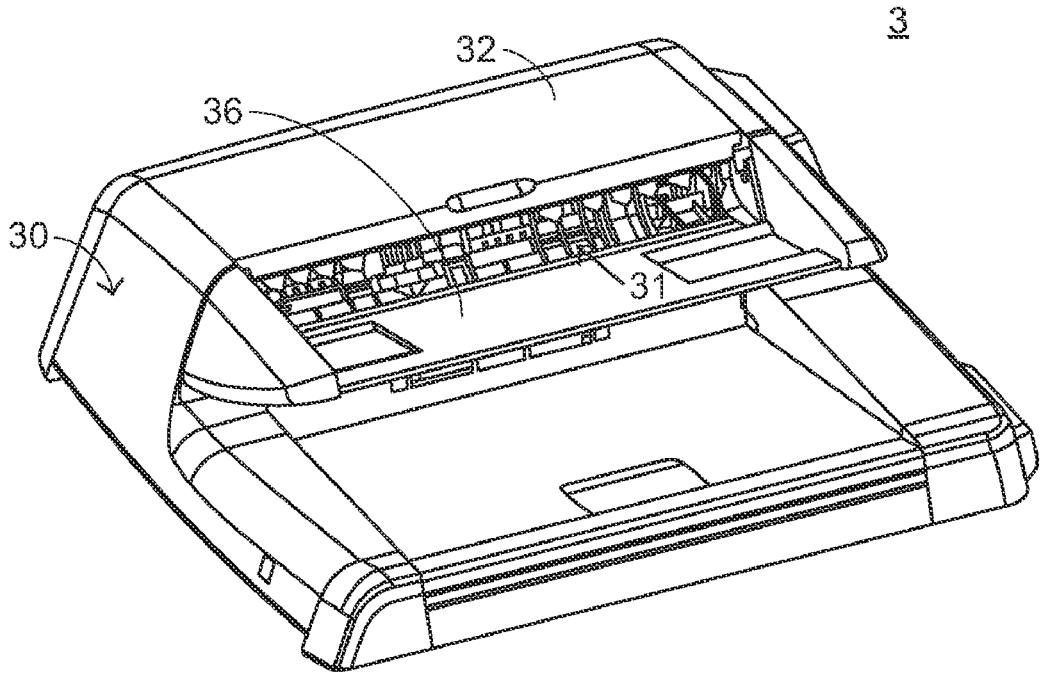
FIG. 4 is a schematic perspective view illustrating the outward appearance of an automatic sheet feeding apparatus according to an embodiment of the present invention.

FIG. 4 is a schematic perspective view illustrating the outward appearance of an automatic sheet feeding apparatus according to an embodiment of the present invention. As shown in FIG. 4, the automatic sheet feeding apparatus 3 comprises a casing 30, a sheet feeding channel 31 and an upper cover 32. The upper cover 32 is pivotally coupled with the casing 30. In a case that the automatic sheet feeding apparatus 3 is suffered from a jamming problem, the upper cover 32 could be uplifted in the direction indicated by the arrow E (as shown in FIG. 5) in order to pull out the jammed document.

Figure 5:
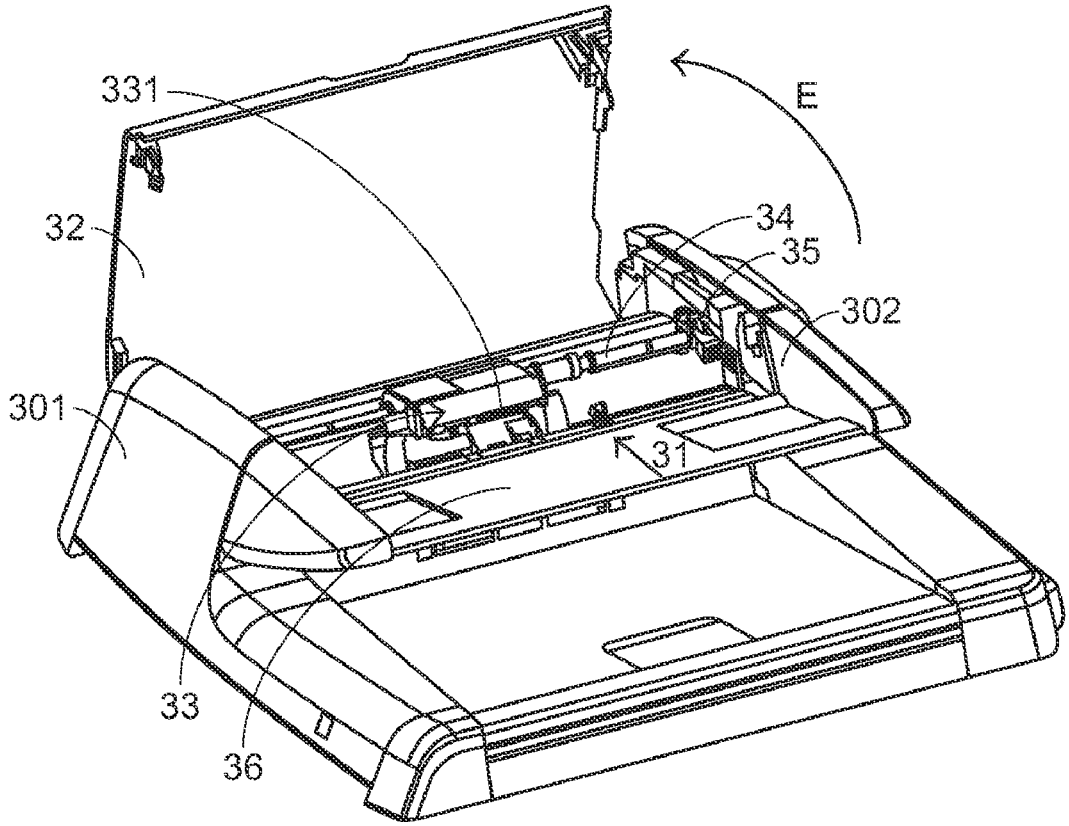
FIG. 5 is a schematic perspective view illustrating the internal portion of the automatic sheet feeding apparatus according to an embodiment of the present invention, in which the upper cover is uplifted.

FIG. 5 is a schematic perspective view illustrating the internal portion of the automatic sheet feeding apparatus according to an embodiment of the present invention, in which the upper cover is uplifted. The automatic sheet feeding apparatus 3 further comprises a sheet pick-up module 33, a driving shaft 34 and a sheet releasing mechanism 35. The casing 30 comprises a first sidewall 301 and a second sidewall 302. The sheet feeding channel 31 is arranged between the first sidewall 301 and the second sidewall 302. The sheet pick-up module 33 comprises a sheet pick-up roller 331, a sheet separation roller 332 (see FIG. 7) and a sheet separation slice 333 (see FIG. 6). Both terminals of the driving shaft 34 are respectively coupled to the first sidewall 301 and the sheet releasing mechanism 35. The sheet separation roller 332 is sheathed around the driving shaft 34 (see FIG. 7). As such, upon rotation of the driving shaft 34, the sheet separation roller 332 is simultaneously rotated. During operation of the automatic sheet feeding apparatus 3, a power source (not shown) of the automatic sheet feeding apparatus 3 provides motive power to the driving shaft 34, thereby driving rotation of the sheet pick-up roller 331 and the sheet separation roller 332. Upon rotation of the sheet pick-up roller 331, the document placed on a sheet input tray 36 of the automatic sheet feeding apparatus 3 is fed by the sheet pick-up roller 331 and then transported to the sheet separation roller 332. Meanwhile, the top surface and the bottom surface of the document are respectively contacted with the sheet separation roller 332 and the sheet separation slice 333, and thus the document is held between the sheet separation roller 332 and the sheet separation slice 333. The sheet separation roller 332 and the sheet separation slice 333 collectively offer a friction force on the document, so that one only document is allowed to be fed into the sheet feeding channel 31 by the sheet pick-up module 33 for each time.

Figure 6:
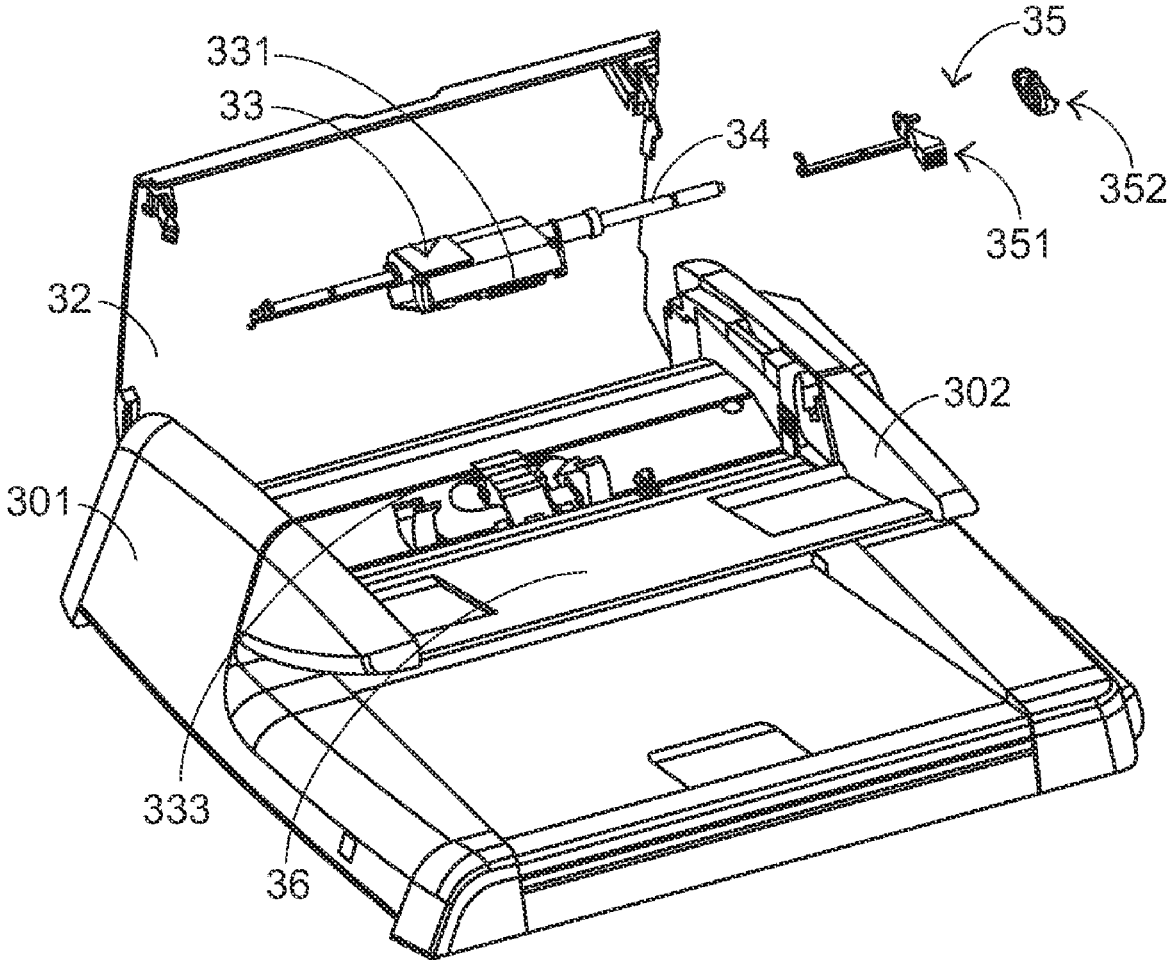
FIG. 6 is a schematic perspective view illustrating a relation between the sheet pick-up module, the driving shaft and the sheet releasing mechanism of the automatic sheet feeding apparatus according to an embodiment of the present invention.
Figure 7:
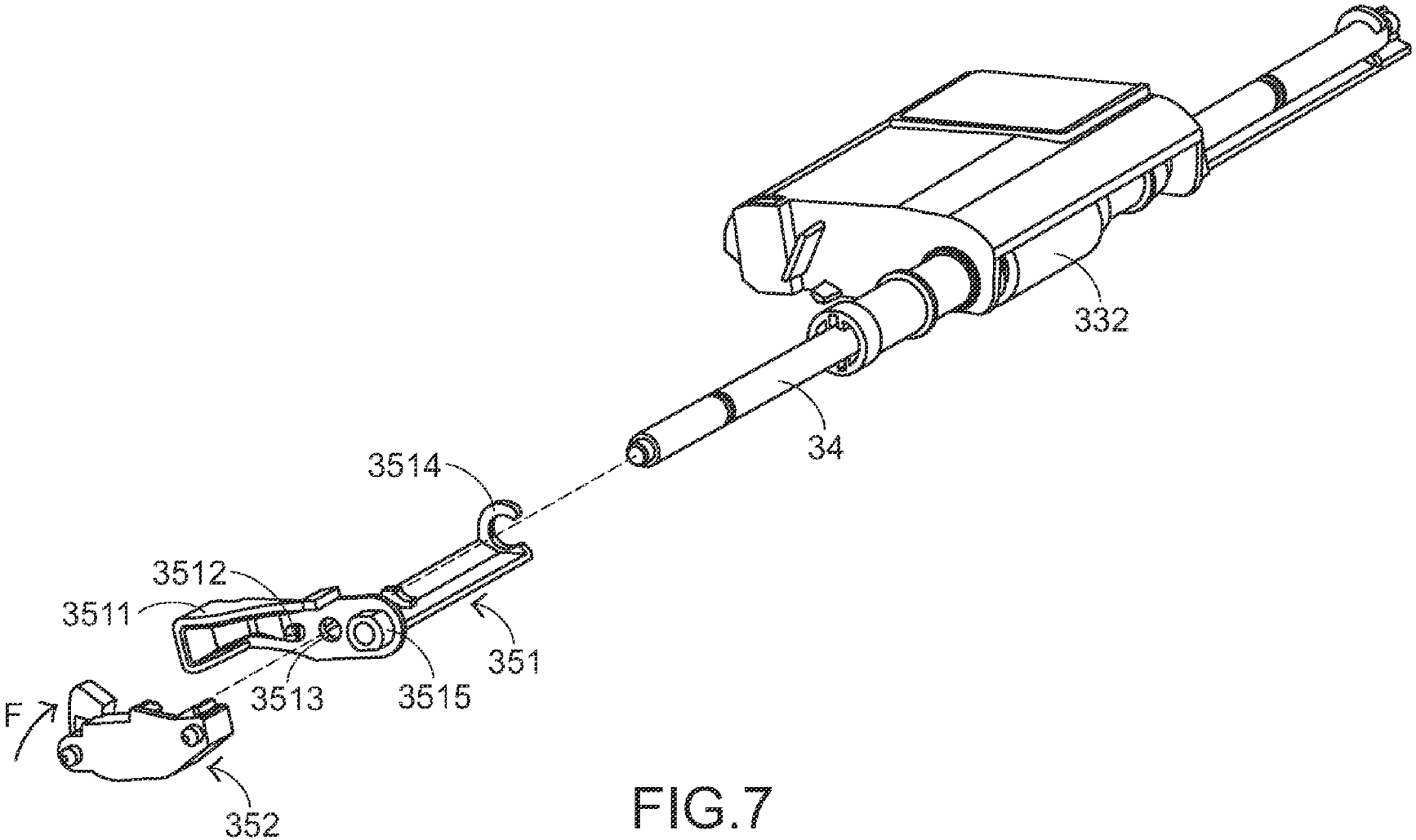
FIG. 7 is a schematic perspective view illustrating a relation between the sheet pick-up module, the driving shaft and the sheet releasing mechanism of the automatic sheet feeding apparatus according to an embodiment of the present invention and taken from another viewpoint.

FIG. 6 is a schematic perspective view illustrating a relation between the sheet pick-up module, the driving shaft and the sheet releasing mechanism of the automatic sheet feeding apparatus according to an embodiment of the present invention. FIG. 7 is a schematic perspective view illustrating a relation between the sheet pick-up module, the driving shaft and the sheet releasing mechanism of the automatic sheet feeding apparatus according to an embodiment of the present invention and taken from another viewpoint. Please refer to FIGS. 6 and 7. The sheet releasing mechanism comprises a control lever 351 and a base 352. The base 352 is disposed and fixed on the second sidewall 302 for supporting the control lever 351. The control lever 351 comprises a handle part 3511, a protruding part 3512, a first collar 3513, a second collar 3514 and a pivotal part 3515. The protruding part 3512 and the first collar 3513 are arranged between the handle part 3511 and the pivotal part 3515. The first collar 3513 is sheathed around the first terminal of the driving shaft 34 for accommodating the first terminal of the driving shaft 34. The second collar 3514 is sheathed around the driving shaft 34 for facilitating securely fixing the driving shaft 34 on the control lever 351. As such, the first terminal of the driving shaft 34 is synchronously moved with the first collar 3513 and the second collar 3514. Moreover, the base 352 has a receptacle 3521 for accommodating the pivotal part 3515 (see FIG. 8). The receptacle 3521 has a curvy bottom surface 35211 for supporting the pivotal part 3515, so that the pivotal part 3515 is rotatable within the receptacle 3521. In a case that the automatic sheet feeding apparatus 3 is suffered from a jamming problem, the user could stir the handle part 3511 of the control lever 351 in the direction indicated by the arrow F. As such, the first collar 3513 is moved in an arc-shaped trajectory, wherein the pivotal part 3515 is served as a center point, and the distance between the first collar 3513 and the pivotal part 3515 is the radius. Since the first terminal of the driving shaft 34 is deviated from the original position, the sheet separation roller 332 is no longer contacted with the jammed document, and the document is not securely held between the sheet separation roller 332 and the sheet separation slice 333. Under this circumstance, the jammed document could be easily pulled out from the region between the sheet separation roller 332 and the sheet separation slice 333.

Figure 8:
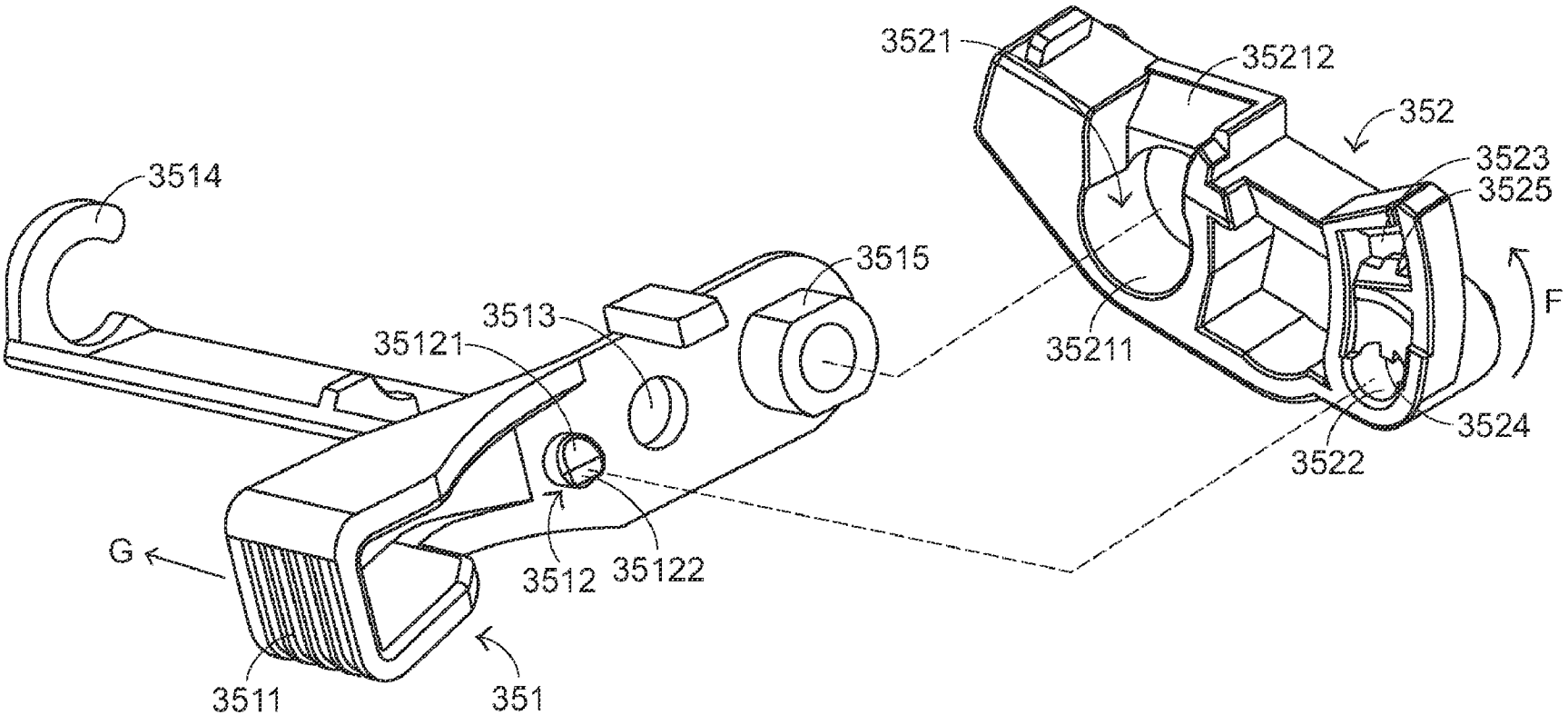
FIG. 8 is a schematic exploded view illustrating a sheet releasing mechanism of the automatic sheet feeding apparatus according to an embodiment of the present invention.

FIG. 8 is a schematic exploded view illustrating a sheet releasing mechanism of the automatic sheet feeding apparatus according to an embodiment of the present invention. Hereinafter, the operating principles and the features of the sheet releasing mechanism will be illustrated with reference to FIG. 8. As shown in FIG. 8, the base 352 has a first restriction groove 3522 and a second restriction groove 3523 for accommodating the protruding part 3512. In a case that the handle part 3511 of the control lever 351 is stirred in the direction F, the protruding part 3512 is moved in an arc-shaped trajectory, wherein the pivotal part 3515 is served as a center point, and the distance between the protruding part 3512 and the pivotal part 3515 is the radius. Along the arc-shaped trajectory, the protruding part 3512 is moved from the first restriction groove 3522 to the second restriction groove 3523. After the jamming condition is eliminated, the handle part 3511 of the control lever 351 is stirred in a direction reverse to the direction F, so that the protruding part 3512 is moved from the second restriction groove 3523 to the first restriction groove 3522 along the arc-shaped trajectory.

During the automatic sheet feeding apparatus 3 is normally operated, the sheet releasing mechanism 35 is in a sheet-holding status. At this moment, the protruding part 3512 is accommodated within the first restriction groove 3522 to facilitate fixing the control lever 351 on the base 352. Under this circumstance, the rocking condition of the control lever 351 is considerably reduced and the adverse influence on the operation of the automatic sheet feeding apparatus 3 is minimized. On the other hand, during the process of releasing the jammed document, the sheet-releasing status. At this moment, the protruding part 3512 is accommodated within the second restriction groove 3523 to facilitate fixing the control lever 351 on the base 352. Since the rocking condition of the control lever 351 is considerably reduced, the user could easily pull out the jammed document without the need of an additional auxiliary tool.

Please refer to FIG. 8 again. The protruding part 3512 of the control lever 351 further comprises a first gliding surface 35121 and a third gliding surface 35122. In addition, a second gliding surface 3524 and a fourth gliding surface 3525 are respectively formed in the first restriction groove 3522 and the second restriction groove 3523.

Figure 9:
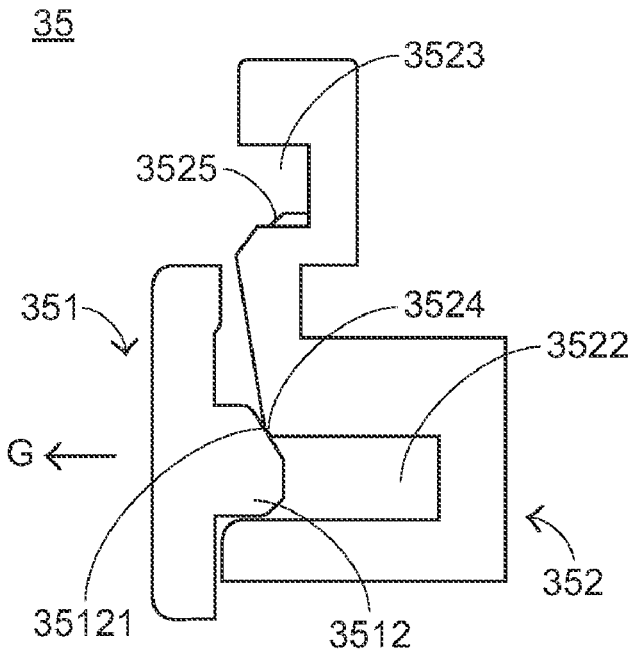
FIG. 9 is a schematic cross-sectional view illustrating a sheet releasing mechanism in the sheet-holding status according to an embodiment of the present invention.
Figure 10:
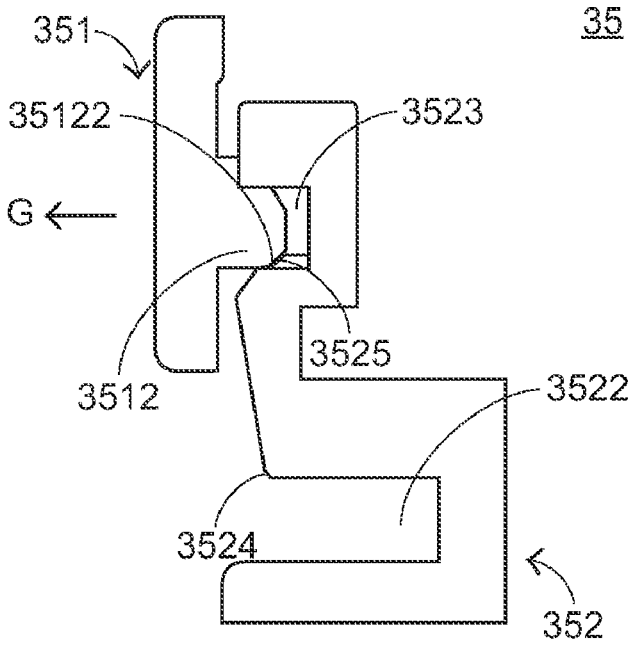
FIG. 10 is a schematic cross-sectional view illustrating a sheet releasing mechanism in the sheet-releasing status according to an embodiment of the present invention.

FIG. 9 is a schematic cross-sectional view illustrating a sheet releasing mechanism in the sheet-holding status according to an embodiment of the present invention. When the sheet releasing mechanism 35 is in the sheet-holding status, the protruding part 3512 is accommodated within the first restriction groove 3522, and the first gliding surface 35121 is contacted with the second gliding surface 3524. FIG. 10 is a schematic cross-sectional view illustrating a sheet releasing mechanism in the sheet-releasing status according to an embodiment of the present invention. When the sheet releasing mechanism 35 is in the sheet-releasing status, the protruding part 3512 is accommodated within the second restriction groove 3523, and the third gliding surface 35122 is contacted with the fourth gliding surface 3525. Due to the contact relation between corresponding gliding surfaces of the sheet releasing mechanism 35, the user does not need to stir the handle part 3511 of the control lever 351 in the direction G (see FIG. 8) to have protruding part 3512 detach from the first restriction groove 3522 or the second restriction groove 3523. On the other hand, by moving the handle part 3511 of the control lever 351 in the direction F or in a direction reverse to the direction F, the protruding part 3512 could be smoothly glided out of the first restriction groove 3522 or the second restriction groove 3523 and moved between the first restriction groove 3522 and the second restriction groove 3523. As a consequence, the user could pull out the jammed document without difficulty.

Moreover, the direction of opening the upper cover 32 of the automatic sheet feeding apparatus 3 is the same as the direction of moving the protruding part 3512 from the first restriction groove 3522 to the second restriction groove 3523 (see FIG. 5). For switching the sheet releasing mechanism 35 from the sheet-releasing status to the sheet-holding status, the user may directly close the upper cover 32 toward the casing 30 without the need of moving the handle part 3511 of the control lever 351 in a direction reverse to the direction F. That is, during the process of closing the upper cover 32, the upper cover 32 will be contacted with the handle part 3511, thereby exerting a pulling force on the handle part 3511. In response to the pulling force, the protruding part 3512 is glided out of the second restriction groove 3523 and moved to the first restriction groove 3522.

Please refer to FIG. 8 again. The receptacle 3521 of the base 352 further has a mouth portion 35212. If the jamming problem of the automatic sheet feeding apparatus 3 is too serious, or if the sheet pick-up module 33 or the driving shaft 34 is damaged and needs to be replaced with a new one after a long-term use period, the user could detach the control lever 351, which supports the sheet pick-up module 33 and the driving shaft 34, from the base 352. As such, the sheet pick-up module 33 or the driving shaft 34 will be replaced with a new one. In particular, a process of detaching the control lever 351 from the base 352 will be illustrated as follows. Firstly, the user stirs the handle part 3511 of the control lever 351 such that the protruding part 3512 is moved to the second restriction groove 3523. Then, the handle part 3511 of the control lever 351 is stirred in the direction G such that the protruding part 3512 is detached from the second restriction groove 3523. Afterwards, the control lever 351 is rotated to a detaching position such that the pivotal part 3515 is detached from the mouth portion 35212 of the receptacle 3521.

From the above description, the protruding part 3512 of the control lever 351 is accommodated within the first restriction groove 3522 or the second restriction groove 3523 of the base 352 when the sheet releasing mechanism 35 of the automatic sheet feeding apparatus 3 is in the sheet-holding status or the sheet-releasing status. As a consequence, the rocking condition of the control lever 351 is considerably reduced. Moreover, since the gliding surfaces 35121 and 35122 are respectively contacted with the gliding surfaces 3524 and 3525 when the sheet releasing mechanism 35 is in the sheet-holding status or the sheet-releasing status, the control lever 351 could be easily manipulated. Therefore, the user could pull out the jammed document of the automatic sheet feeding apparatus 3 in a more convenient manner.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A sheet feeding apparatus with a sheet releasing mechanism, said sheet feeding apparatus comprising:

a casing having a first sidewall and a second sidewall;

a sheet feeding channel arranged between said first sidewall and said second sidewall;

a sheet pick-up module comprising a sheet separation roller and a sheet separation slice; and a driving shaft connected to said sheet pick-up module for driving said sheet separation roller, wherein both terminals of said driving shaft are respectively coupled to said first sidewall and said sheet releasing mechanism;

wherein said sheet releasing mechanism is operated in a sheet-holding status or a sheet-releasing status, and said sheet releasing mechanism comprises:

a control lever comprising a protruding part for adjusting said sheet releasing mechanism to be in said sheet-holding status or said sheet-releasing status; and a base disposed on said second sidewall for supporting said control lever, and comprising a first restriction groove and a second restriction groove for accommodating said protruding part, wherein said sheet releasing mechanism is in said sheet-holding status when said protruding part is accommodated within said first restriction groove, and said sheet releasing mechanism is in said sheet-releasing status when said protruding part is accommodated within said second restriction groove.

2. The sheet feeding apparatus according to claim 1 wherein said control lever further comprises:

a handle part for changing a position of said control lever such that said protruding part is accommodated within said first restriction groove or said second restriction groove;

a pivotal part; and a first collar for accommodating a terminal of said driving shaft, wherein said base further comprises a receptacle for accommodating said pivotal part.

3. The sheet feeding apparatus according to claim 2 wherein said protruding part further comprises a first gliding surface, and a second gliding surface is formed in said first restriction groove, wherein said first gliding surface is contacted with said second gliding surface when said sheet releasing mechanism is in said sheet-holding status.

4. The sheet feeding apparatus according to claim 3 wherein said protruding part further comprises a third gliding surface, and a fourth gliding surface is formed in said second restriction groove, wherein said third gliding surface is contacted with said fourth gliding surface when said sheet releasing mechanism is in said sheet-releasing status.

5. The sheet feeding apparatus according to claim 4 wherein said receptacle comprises:

a mouth portion, wherein said pivotal part of said control lever is permitted to be detached from said receptacle through said mouth portion; and a curvy bottom surface for supporting said pivotal part.

6. The sheet feeding apparatus according to claim 2 wherein said control lever further comprises a second collar, which is sheathed around said driving shaft for facilitating fixing said driving shaft.

7. The sheet feeding apparatus according to claim 1 further comprising an upper cover pivotally coupled with said casing, wherein said upper cover is permitted to be uplifted when said upper cover is rotated in an opening direction, and said opening direction is the same as a direction of moving said protruding part from said first restriction groove to said second restriction groove.

* * * * *